US009682463B1

(12) United States Patent
Aldredge et al.

(10) Patent No.: US 9,682,463 B1
(45) Date of Patent: Jun. 20, 2017

(54) LOCKING PLIERS

(71) Applicants: Robert L. Aldredge, Englewood, OH (US); Robert L. Aldredge, Jr., Dayton, OH (US); Joseph H. Aldredge, Englewood, OH (US)

(72) Inventors: Robert L. Aldredge, Englewood, OH (US); Robert L. Aldredge, Jr., Dayton, OH (US); Joseph H. Aldredge, Englewood, OH (US)

( * ) Notice: Subject to any disclaimer, the term of this patent is extended or adjusted under 35 U.S.C. 154(b) by 0 days.

(21) Appl. No.: 15/406,839

(22) Filed: Jan. 16, 2017

(51) Int. Cl.
*B25B 7/12* (2006.01)

(52) U.S. Cl.
CPC ..... *B25B 7/123* (2013.01)

(58) Field of Classification Search
CPC ..... B25B 7/12; B25B 7/123
USPC ..... 81/367, 368
See application file for complete search history.

(56) References Cited

U.S. PATENT DOCUMENTS 2,503,783 A * 4/1950 Ward ..... B25B 7/123 81/367
2,532,659 A * 12/1950 Burns ..... B25B 7/123 81/371
2,556,725 A * 6/1951 Hurlbut ..... B25B 7/10 140/113
2,838,973 A * 6/1958 Petersen ..... B25B 7/123 81/369
3,285,107 A * 11/1966 Kasper ..... B25B 7/123 81/368
5,056,385 A * 10/1991 Petersen ..... B25B 7/123 81/367
6,095,019 A * 8/2000 Warheit ..... B25B 7/123 81/368
7,762,162 B2 * 7/2010 Phillips, Sr. ..... B25B 7/10 81/367
8,656,813 B1 * 2/2014 Aldredge ..... B25B 7/12 81/368
8,919,229 B1 * 12/2014 Aldredge ..... B25B 7/123 81/367

* cited by examiner

*Primary Examiner* — Hadi Shakeri
(74) *Attorney, Agent, or Firm* — Donald J. Ersler

(57) ABSTRACT

A locking pliers preferably includes a fixed jaw, a moveable jaw, a fixed handle, a toggle link, a power link and a moveable handle. The fixed jaw is retained in a first end of the fixed handle. The moveable jaw is pivotally retained in substantially the first end of the fixed handle. An adjustment screw is retained in a second end of the fixed handle. An end of the adjustment screw engages a first end of the toggle link. The moveable handle is pivotally engaged with the toggle link. A first end of the power link is pivotally engaged with a second end of the toggle link. The power link is also slidably engaged with the moveable handle. The moveable jaw is pivotally engaged with a second end of the power link.

10 Claims, 7 Drawing Sheets

LOCKING PLIERS

BACKGROUND OF THE INVENTION

1. Field of the Invention

The present invention relates generally to hand tools and more specifically to a locking pliers, which requires less effort to operate than that of the prior art.

2. Discussion of the Prior Art

U.S. Pat. No. 5,056,385 to Petersen discloses a compound toggle link. U.S. Pat. No. 6,095,019 to Warheit et al. discloses a locking pliers tool. U.S. Pat. No. 7,762,162 to Phillips, Sr. et al. discloses a locking pliers with cam. U.S. Pat. No. 8,656,813 to Aldredge et al. discloses a locking pliers.

Accordingly, there is a clearly felt need in the art for a locking pliers, which requires less effort to operate than that of the prior art.

SUMMARY OF THE INVENTION

The present invention provides a locking pliers, which requires less effort to operate than that of the prior art. The locking pliers preferably includes a fixed jaw, a moveable jaw, a fixed handle, an adjusting screw, a toggle link, at least one power link and a moveable handle. The fixed jaw, the moveable jaw, the fixed handle, the adjusting screw and a biasing spring are preferably taken from an Irwin item no. 502L3 vise grips, but other parts may also be used. U.S. Pat. No. 5,056,385 is hereby incorporated into this patent application by reference in its entirety. The fixed jaw is retained in one end of the fixed handle and the adjusting screw is threadably retained in an opposing end of the fixed handle. The moveable jaw is pivotally retained in the one end of the fixed handle.

The toggle link preferably includes a first toggle end, a second toggle end and a stop projection. A curved surface is formed in the first toggle end to receive an end of the adjusting screw. Each power link includes a first power end and a second power end. The second toggle end of the toggle link is pivotally retained on the first power end of the at least one power link with a first power pin. It is preferable to have two power links, which are retained on opposing sides of the toggle link. The second power end of the at least one power link is pivotally retained on an end of the moveable jaw with a second power pin. The moveable handle includes a U-shaped cross section, a handle hole and a handle slot. The handle slot is formed through one end of the handle and forms an acute angle with an axis of the handle. The handle hole is formed through the handle, near the handle slot.

A toggle hole is formed through the toggle link, adjacent the first power pin and on the same axis as the first power pin. A first handle pin is inserted through the handle hole and pressed into the toggle hole to pivotally retain the moveable handle relative to the toggle link. A power handle hole is formed through substantially a middle of the at least one power link. A handle slot pin is inserted through the handle slot and pressed into the power handle hole. An alternative design of the locking pliers includes the handle slot replaced with a second handle hole, and the power handle hole is replaced with a power slot. An axis of the power slot is located on a lengthwise axis of the power link.

Accordingly, it is an object of the present invention to provide a locking pliers, which requires less effort to operate than that of the prior art.

These and additional objects, advantages, features and benefits of the present invention will become apparent from the following specification.

DETAILED DESCRIPTION OF THE PREFERRED EMBODIMENTS

Figure 1:
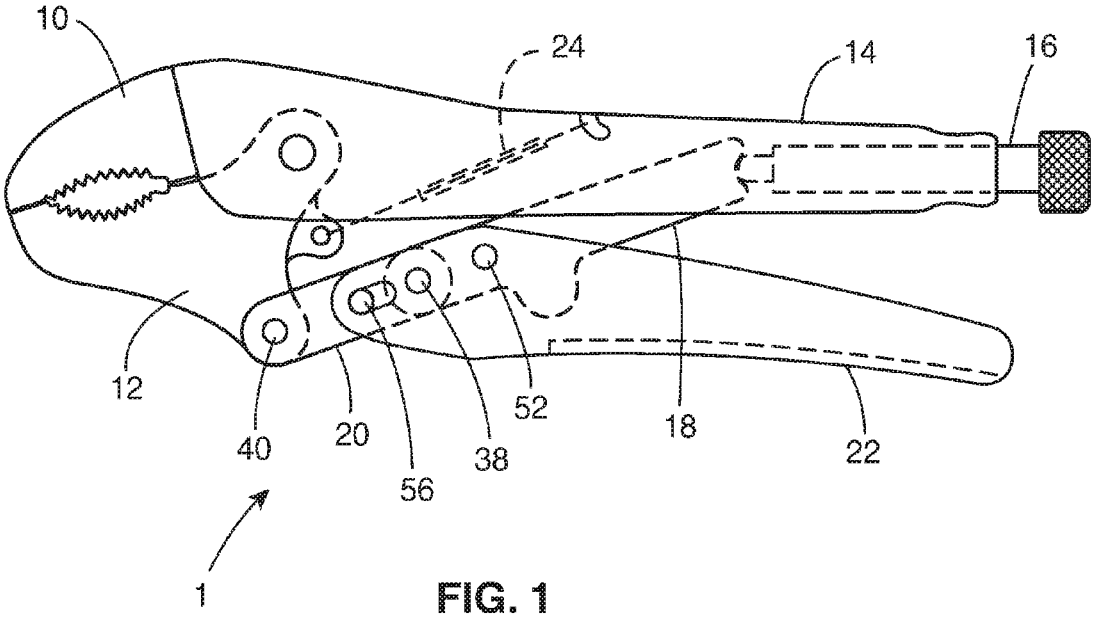
FIG. 1 is a side view of a locking pliers in a closed orientation in accordance with the present invention.
Figure 1A:
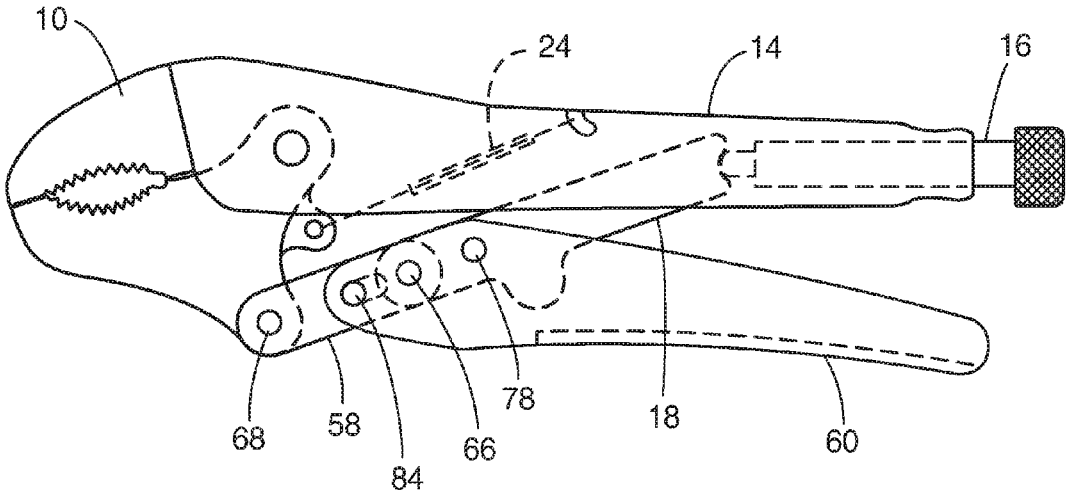
FIG. 1*a* is a side view of an alternative design of a locking pliers in a closed orientation with a pivoting slot moved from a handle to a power link in accordance with the present invention.
Figure 2:
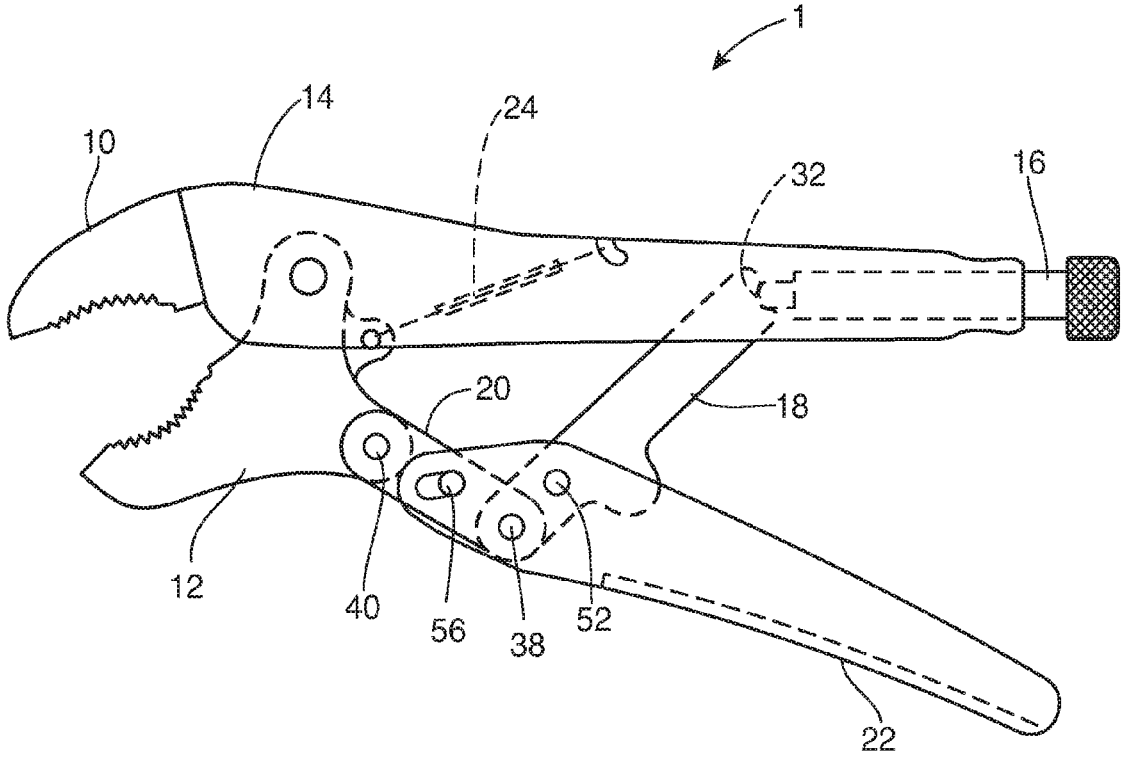
FIG. 2 is a side view of a locking pliers in an open orientation in accordance with the present invention.
Figure 2A:
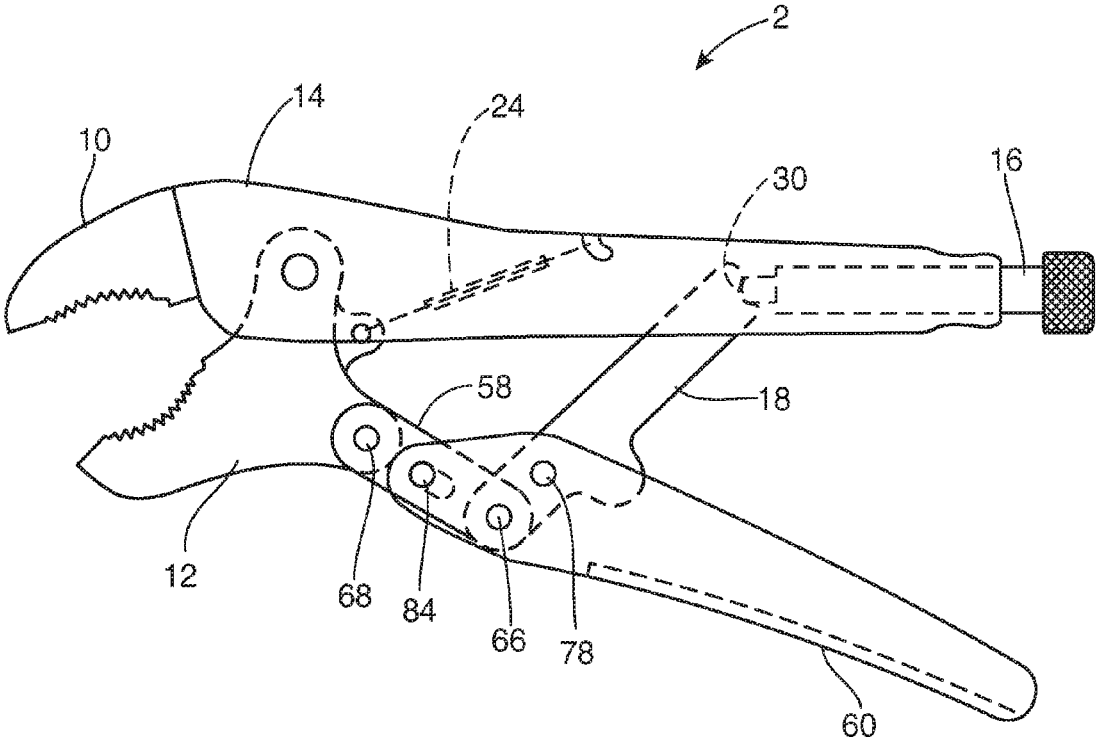
FIG. 2*a* is a side view of an alternative design of a locking pliers in an open orientation with a pivoting slot moved from a handle to a power link in accordance with the present invention.
Figure 3:
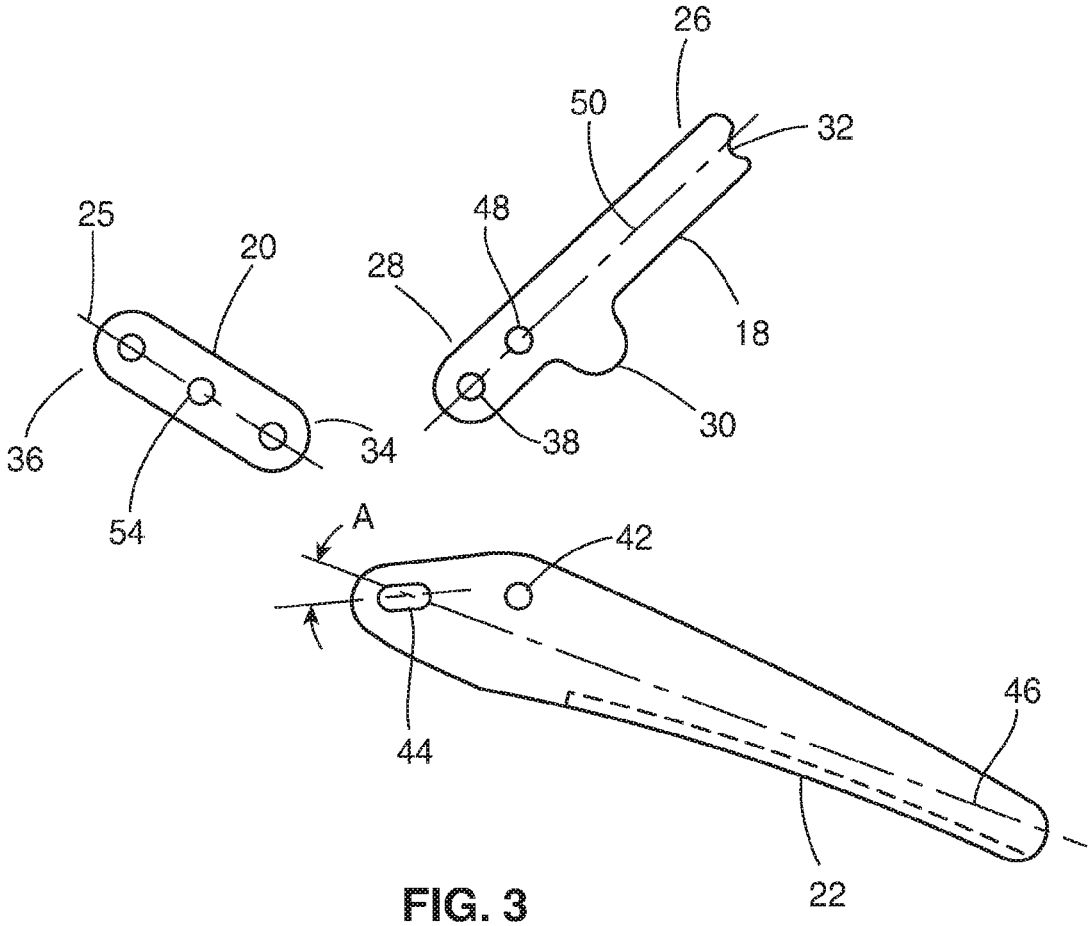
FIG. 3 is an exploded side view of a toggle link, a power link and a moveable handle of a locking pliers in an open orientation in accordance with the present invention.
Figure 3A:
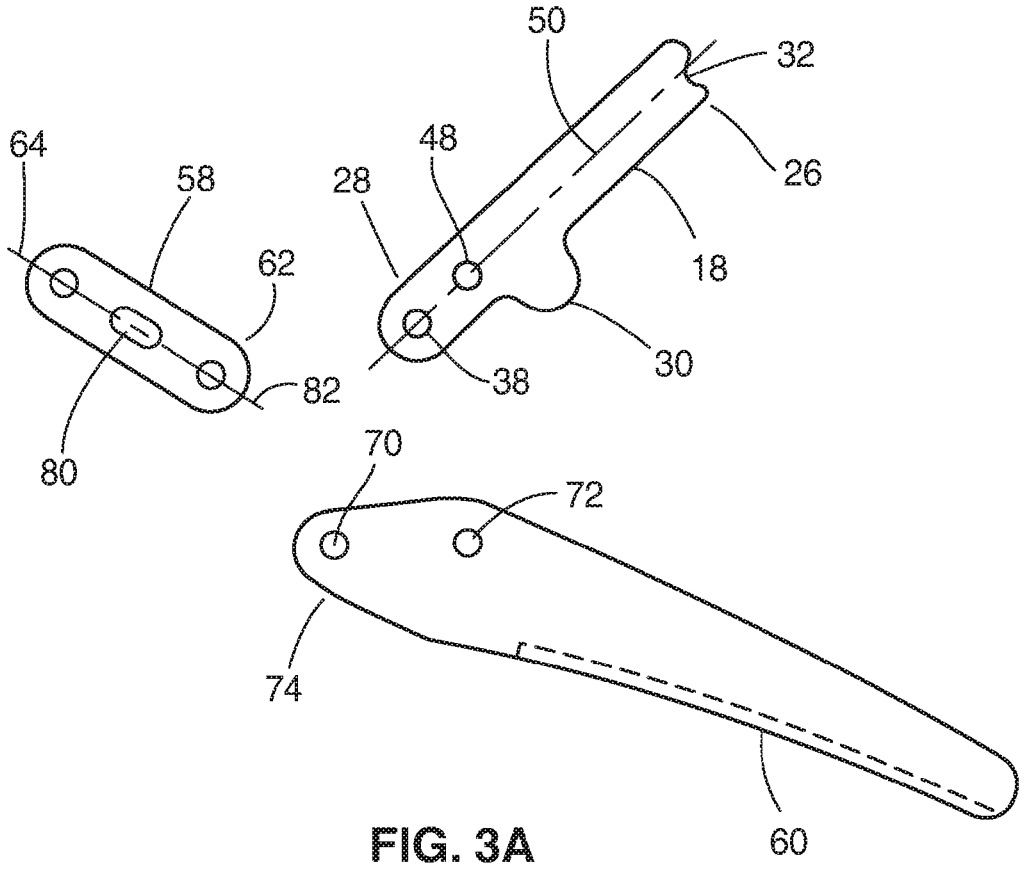
FIG. 3*a* is an exploded side view of a toggle link, a power link and a moveable handle of an alterative design of a locking pliers in an open orientation in accordance with the present invention.
Figure 4:
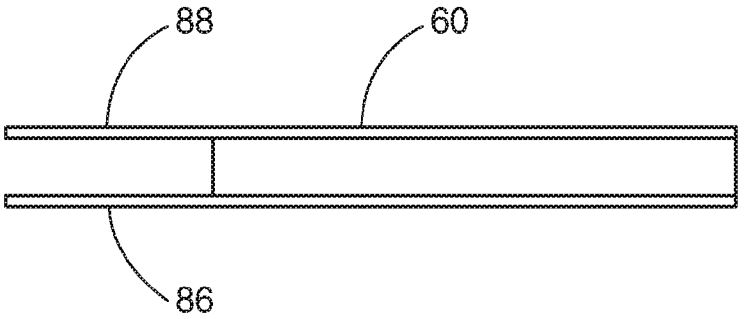
FIG. 4 is a top view of a moveable handle of a locking pliers in accordance with the present invention.
Figure 5:
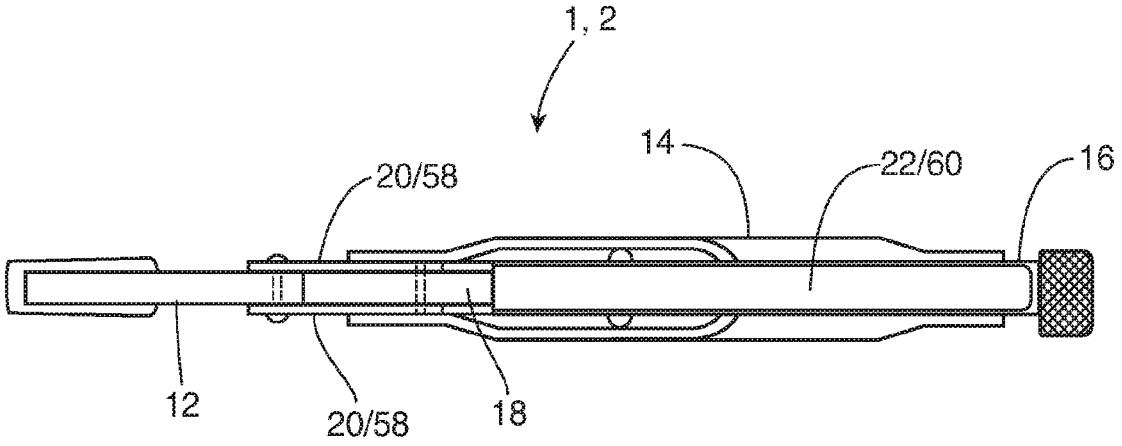
FIG. 5 is a bottom view of a locking pliers in a closed orientation in accordance with the present invention.

With reference now to the drawings, and particularly to FIG. 1, there is shown a side view of a locking pliers 1 in a closed orientation. With reference to FIGS. 2, 3, 4 and 5, the locking pliers 1 preferably includes a fixed jaw 10, a moveable jaw 12, a fixed handle 14, an adjusting screw 16, a toggle link 18, at least one power link 20 and a moveable handle 22. The fixed jaw 10, the moveable jaw 12, the fixed handle 14, the adjusting screw 16 and a biasing spring 24 are preferably taken from an Irwin item no. 502L3 vise grips, but other parts may also be used. U.S. Pat. No. 5,056,385 is hereby incorporated into this patent application by reference in its entirety. The fixed jaw 10 is retained in one end of the fixed handle 14 and the adjusting screw 16 is threadably retained in an opposing end of the fixed handle 14. The moveable jaw 12 is pivotally retained in the one end of the fixed handle 14.

The toggle link 18 preferably includes a first toggle end 26, a second toggle end 28 and a stop projection 30. The stop projection 30 acts as a past top dead center stop for locking the jaws 10, 12 of the locking pliers 1. A curved surface 32 is formed in the first toggle end 26 to receive an end of the adjusting screw 16. Each power link 20 includes a first power end 34 and a second power end 36. The second toggle end 28 of the toggle link 18 is pivotally retained on the first power end 34 of the at least one power link 20 with a first power pin 38. It is preferable to have two power links 20, which are retained on opposing sides of the toggle link 18. The second power end 36 of the at least one power link 20 is pivotally retained on an end of the moveable jaw 12 with a second power pin 40. The moveable handle 22 includes a U-shaped cross section, a handle hole 42 and a handle slot 44. The handle slot 44 is formed through one end of the handle 22 and forms an acute angle "A" with an axis 46 of the moveable handle 22. The handle hole 42 is formed through the handle 22, near the handle slot 44.

A toggle hole 48 is formed through the toggle link 18, adjacent the first power pin 38 and preferably on a lengthwise axis 50 of the toggle link 18. The first power pin 38 is preferably formed on the lengthwise axis 50. A first handle pin 52 is inserted through the handle hole 42 and pressed into the toggle hole 48 to pivotally retain the moveable handle 22 relative to the toggle link 18. A power handle hole 54 is formed through substantially a middle of the at least one power link 20. The power handle hole 54 is preferably formed on a lengthwise axis 25 of the power link 20. A handle slot pin 56 is inserted through the handle slot 44 and pressed into the power handle hole 54.

With reference to FIGS. 1*a*, 2*a*, 3*a*, 4 and 5, an alternative design of the locking pliers 2 preferably includes the fixed jaw 10, the moveable jaw 12, the fixed handle 14, the adjusting screw 16, the toggle link 18, at least one power link 58 and a moveable handle 60. Each power link 58 includes a first power end 62 and a second power end 64. The second toggle end 28 of the toggle link 18 is pivotally retained on the first power end 62 of the at least one power link 58 with a first power pin 66. It is preferable to have two power links 58, which are retained on opposing sides of the toggle link 18. The second power end 64 of the at least one power link 58 is pivotally retained on an end of the moveable jaw 12 with a second power pin 68.

The moveable handle 60 includes a U-shaped cross section, a first handle hole 70 and a second handle hole 72. The first handle hole 70 is formed at a first end 74 of the moveable handle 60. The second handle hole 72 formed near the first handle hole 70. A first handle pin 78 is inserted through the second handle hole 72 and pressed into the toggle hole 48 to pivotally retain the moveable handle 60 relative to the toggle link 18. A power slot 80 is formed through substantially a middle of the at least one power link 58. An axis of the power slot 80 is located on a lengthwise axis 82 of the power link 58. A power slot pin 84 is pressed into the first handle hole 70 in a first side 86 of the moveable handle 60; through the power slot 80 and into the first handle hole 70 in a second side 88 of the moveable handle 60.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A locking pliers comprising:

a fixed handle having an adjusting device disposed on one end;

a fixed jaw is rigidly retained in an opposing end of the fixed handle;

a moveable jaw is pivotally retained in substantially the opposing end of the fixed handle;

at least one power link having a first end and a second end, said first end of said power link is pivotally retained with said moveable jaw;

a moveable handle having a first end and a second end, a slot is formed in said first end of said moveable handle, a handle pivot hole is formed adjacent said slot; and a toggle link having a first end and a second end, said first end of said toggle link is in contact with an end of said adjusting device, said second end of said toggle link is pivotally engaged with said second end of said power link, said toggle link is pivotally engaged with said handle pivot hole, substantially a middle of said power link is slidably engaged with said slot utilizing a power pin.

2. The locking pliers of claim 1 wherein:

said adjusting device is an adjustment screw.

3. The locking pliers of claim 1 wherein:

said moveable handle includes a U-shaped cross section.

4. The locking pliers of claim 3 wherein:

an inner width of said of said U-shaped cross section is sized to receive a thickness of said toggle link and two of said power links.

5. The locking pliers of claim 1 wherein:

a stop projection extends from substantially said second end of said toggle link.

6. A locking pliers comprising:

a fixed handle having an adjusting device disposed on one end;

a fixed jaw is rigidly retained in an opposing end of the fixed handle;

a moveable jaw is pivotally retained in substantially the opposing end of the fixed handle;

at least one power link having a first end and a second end, said first end of said power link is pivotally retained with said moveable jaw, a slot is formed in substantially a middle of said power link;

a moveable handle having a first end and a second end, a first hole is formed in said first end of said moveable handle, a second hole is formed adjacent said first hole; and a toggle link having a first end and a second end, said first end of said toggle link is in contact with an end of said adjusting device, said second end of said toggle link is pivotally engaged with said second end of said power link, said toggle link is pivotally engaged with said second hole, said first hole is slidably engaged with said slot utilizing a handle pin.

7. The locking pliers of claim 6 wherein:

said adjusting device is an adjustment screw.

8. The locking pliers of claim 6 wherein:

said moveable handle includes a U-shaped cross section.

9. The locking pliers of claim 8 wherein:

an inner width of said U-shaped cross section is sized to receive a thickness of said toggle link and two of said power links.

10. The locking pliers of claim 6 wherein:

a stop projection extends from substantially said second end of said toggle link.

* * * * *